US006512506B1

(12) United States Patent
Shimada

(10) Patent No.: US 6,512,506 B1
(45) Date of Patent: Jan. 28, 2003

(54) DRIVING DEVICE FOR LIQUID CRYSTAL DISPLAY ELEMENT

(75) Inventor: Nobushige Shimada, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/158,581

(22) Filed: Sep. 22, 1998

(30) Foreign Application Priority Data

Sep. 22, 1997 (JP) ..... 9-257173

(51) Int. Cl.[7] ..... G09G 3/36
(52) U.S. Cl. ..... 345/99; 349/94
(58) Field of Search ..... 345/98–100, 91, 345/101, 204, 205, 94, 95, 96; 349/72

(56) References Cited

U.S. PATENT DOCUMENTS

| | | | | | |
|---|---|---|---|---|---|
| 4,606,050 | A | * | 8/1986 | Sekigawa et al. | 375/75 |
| 4,901,066 | A | * | 2/1990 | Kobayashi et al. | 345/94 |
| 4,962,376 | A | * | 10/1990 | Inoue et al. | 345/97 |
| 5,398,042 | A | * | 3/1995 | Hughes | 345/94 |
| 5,406,308 | A | * | 4/1995 | Shiki | 345/127 |
| 5,408,252 | A | * | 4/1995 | Oki et al. | 345/205 |
| 5,436,742 | A | * | 7/1995 | Tanaka et al. | 349/25 |
| 5,592,190 | A | * | 1/1997 | Okada et al. | 345/89 |
| 5,610,627 | A | * | 3/1997 | Inamori et al. | 345/99 |
| 5,675,356 | A | * | 10/1997 | Ooki et al. | 345/101 |
| 5,754,153 | A | * | 5/1998 | Mizutome et al. | 345/97 |
| 5,757,349 | A | * | 5/1998 | Togashi | 345/91 |
| 5,867,141 | A | * | 2/1999 | Asada et al. | 345/100 |
| 5,892,504 | A | * | 4/1999 | Knapp | 345/204 |
| 5,914,699 | A | * | 6/1999 | Imamura | 345/99 |
| 5,966,111 | A | * | 10/1999 | Koshoubu et al. | 345/94 |
| 5,977,944 | A | * | 11/1999 | Kubota et al. | 345/100 |
| 5,999,156 | A | * | 12/1999 | Shimada et al. | 345/94 |
| 6,020,872 | A | * | 2/2000 | Mizukata et al. | 345/99 |
| 6,061,044 | A | * | 5/2000 | Ohno et al. | 345/95 |
| 6,072,453 | A | * | 6/2000 | Okamoto et al. | 345/97 |
| 6,104,368 | A | * | 8/2000 | Bonnett et al. | 345/94 |

FOREIGN PATENT DOCUMENTS

| | | | |
|---|---|---|---|
| JP | A-59-116792 | | 7/1984 |
| JP | A-3-10217 | | 1/1991 |
| JP | 03010217 | * | 1/1991 |
| JP | 04005623 A | | 1/1992 |
| JP | A-5-7136 | | 1/1993 |
| JP | 05-323385 | | 12/1993 |
| JP | 07-072457 | | 3/1995 |
| JP | 07-134282 | | 5/1995 |
| JP | A-9-258698 | | 10/1997 |
| JP | A-10-171416 | | 6/1998 |

OTHER PUBLICATIONS

Japanese Patent Office Notice of Rejection for Japanese Patent Application No. 9–257173; Oct. 2, 2001, (3 pages translated, 2 pages original Japanese).

* cited by examiner

*Primary Examiner*—Richard Hjerpe
*Assistant Examiner*—Kevin M. Nguyen
(74) *Attorney, Agent, or Firm*—Birch, Stewart, Kolasch & Birch, LLP

(57) ABSTRACT

A control section of a driving device for a liquid crystal display device element selects one dividing ratio pattern from at least two different predetermined dividing ratio patterns, and a 1-line selection period is divided into a plurality of timing segments by a timing signal outputted from a timing generating circuit based on the selection result. A picture element is charged by having a predetermined voltage applied during at least one timing segment out of the plurality of timing segments depending on whether the picture element is ON or OFF, and the charge supplied to the picture element is discharged during at least another timing segment in accordance with the ON/OFF state of the picture element.

18 Claims, 9 Drawing Sheets

FIG.5(a) SEP="L"
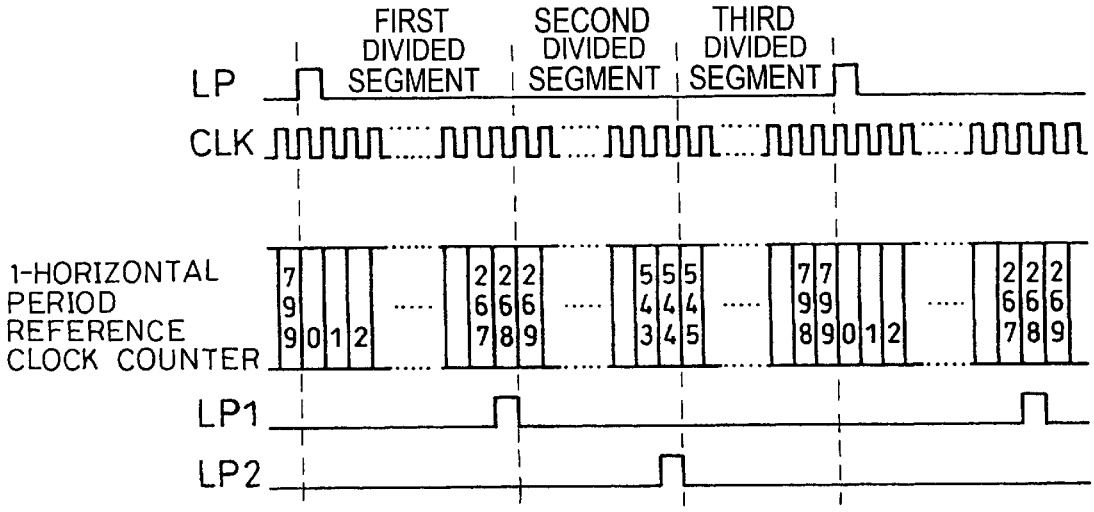
FIG.5(b) SEP="H"
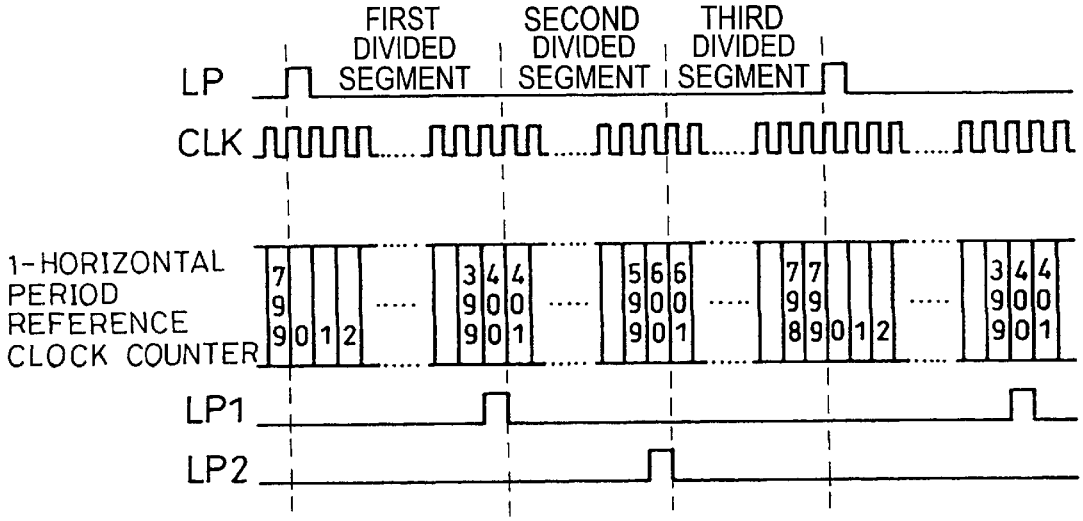

SELECTION PERIOD
SELECTION PERIOD
LP

M

Vo
V1
V2
V3
V4
V5
Vb
Vb
4Vb
Vb
Vb

Vo
V1
V2
V3
V4
V5

Vo
V2
GND
Vb
Vb
-V2
-Vo
2Vb

DRIVING DEVICE FOR LIQUID CRYSTAL DISPLAY ELEMENT

FIELD OF THE INVENTION

The present invention relates to a driving device for driving a liquid crystal display element employed in a liquid crystal display of a matrix electrode structure using a multiplex (time division) driving method, and more particularly, to a driving device for driving a liquid crystal display element by dividing a 1-line selection period into more than one segment.

BACKGROUND OF THE INVENTION

Recently, liquid crystal displays are used in diversified fields including AV (Audio Visual) and OA (Office Automation) systems. Low-end products employ passive type liquid crystal displays, whereas high-end products employ liquid crystal displays driven by the active matrix driving method using switching elements, such as 3-terminal elements represented by TFTs (Thin Film Transistors) and 2-terminal elements represented by MIM (Metal-Insulator-Metal) elements.

Here, a conventional liquid crystal display will be explained with reference to FIG. 7. A display panel 102 of a conventional liquid crystal display 101 includes data electrode lines X1–Xn and scanning electrode lines Y1–Ym that intersect with the data electrode lines X1–Xn. Serially connected picture elements 103 are provided individually to portions enclosed by the data electrode lines X1–Xn and scanning electrode lines Y1–Ym. The picture elements 103 may include switching elements composed of the 2-terminal or 3-terminal elements.

A control section 104 of the liquid crystal display 101 receives an external interface signal IN from an unillustrated external circuit. For example, as shown in FIG. 8, the external interface signal IN includes a data signal DATA which conveys the display state of each picture element 103 in sync with a reference clock CLK, and a data enable signal ENAB which indicates whether the data signal DATA should be displayed or not. The external interface signal IN also includes a horizontal direction synchronizing signal LP supplied for every data signal DATA for each of the scanning electrode lines Y1–Ym, and a vertical direction synchronizing signal FP supplied for each screen (frame).

It is generally difficult to specify how many times the reference clock CLK is inputted in one cycle of the horizontal direction; synchronizing signal LP. This is because, in case of a display control circuit designed using, as a memory IC for storing the data signal DATA, a memory generally known as a DRAM which requires a refresh pulse, the frequency of the reference clock CLK varies with the specification of an external circuit (not shown) which generates an external interface signal.

The control section 104 generates a control signal which indicates a driving voltage and a driving timing of each of the data electrode lines X1–Xn and scanning electrode lines Y1–Ym in accordance with the external interface signal IN, and sends the same to a scanning electrode driving circuit 105 and a data electrode driving circuit 106. The scanning electrode driving circuit 105 selects the scanning electrode lines Y1–Ym successively in accordance with the control signal and applies a predetermined voltage to each. On the other hand, the data electrode driving circuit 106 applies a predetermined voltage to each of the data electrode lines X1–Xn in response to display data of the picture elements 103.

Here, a brief explanation of a voltage applied to one particular picture element 103 connected to a data electrode line Xi and a scanning electrode line Yj will be given with reference to FIGS. 9(*a*) through 9(*e*).

As shown in FIG. 9 (*a*), the horizontal direction synchronizing signal LP is applied to all the picture elements 103 for each of the scanning electrode lines Y1–Ym. Of the entire horizontal direction synchronizing signal LP, a period corresponding to the scanning electrode line Yj is a selection period for the subject picture element 103. An A/C signal M shown in FIG. 9(*b*) is generated based on the horizontal direction synchronizing signal LP of FIG. 9(*a*). The A/C signal M is a signal inverting periodically, for example, for every scanning electrode line.

During a non-selection period, that is, while the subject picture element 103 is not selected, the scanning electrode driving circuit 105 applies a voltage V1 or V4 to the scanning electrode line Yj as shown in FIG. 9(*c*) in accordance with the A/C signal M of FIG. 9(*b*). On the other hand, the data electrode driving circuit 106 selects a voltage to be applied to the data electrode line Xi depending on whether the subject picture element 103 connected to the currently selected scanning electrode line Yj and data electrode line Xi stays ON or OFF.

For example, as shown in FIG. 9(*d*), while the A/C signal M is in the high level, a voltage V0 indicated by a solid line is selected if the subject picture element 103 stays ON, and a voltage V2 indicated by a dotted line is selected if the subject picture element 103 stays OFF. On the other hand, while the A/C signal M is in the low level, a voltage V5 indicated by the solid line is selected if the subject picture element 103 stays ON, and a voltage V3 indicted by a dotted line is selected if the subject picture element 103 stays OFF. Consequently, as shown in FIG. 9(*e*), the voltage applied to the subject picture element 103 connected to the scanning electrode line Yj and data electrode line Xi varies within a range from a grounding level GND to a voltage Vb.

On the other hand, during the selection period, either a voltage V5 or V1 is applied to the scanning electrode line Yj in, response to the A/C signal M as shown in FIG. 9(*c*). Thus, in case that the data signal DATA conveys an ON command, as indicated by a solid line in FIG. 9(*e*), a voltage V0 is applied to the subject picture element 103 while the A/C signal M is in the low level, and a voltage −V0 is applied to the subject picture element 103 while the A/C signal M is in the high level, whereupon the subject picture element 103 comes ON. Likewise, in case that the data signal DATA conveys an OFF command, as indicated by dotted lines in FIG. 9(*e*), a voltage V2 is applied to the subject picture element 103 while the A/C signal M is in the low level, and a voltage −V2 is applied to the subject picture element 103 while the A/C signal M is in the high level, whereupon the subject picture element 103 goes OFF. Consequently, both the driving circuits 105 and 106 can drive the picture elements 103 individually by the voltage averaging method.

Incidentally, the characteristics of the liquid crystal display vary with a change of environmental conditions, such as temperatures, irregular characteristics of the display panel per se as an electronic component, etc.

For instance, it is known that a display quality, particularly, the contrast, of a liquid crystal display using the 2-terminal elements depends largely on ambient temperature. FIG. 10 shows V-CR (voltage-vs.-contrast) characteristics of the liquid crystal display using the 2-terminal elements. In the drawing, a curve (a) represents the characteristics at normal temperature, a curve (b) represents those at high temperatures, and a curve (c) represents those at low temperatures. FIG. 10 reveals that, when the temperature is low, a maximum contrast value and a liquid crystal applying voltage (hereinafter, referred to as maximum contrast voltage) necessary to obtain the maximum contrast value are larger compared with those at normal temperature. FIG. 10 also reveals that, when the temperature is high, both the maximum contrast value and maximum contrast voltage are smaller compared with those at normal temperature.

Therefore, when the temperature is high, the maximum contrast value becomes too small, whereas when the temperature is low, the maximum contrast voltage becomes so large that it exceeds a specification value of a withstand voltage for a liquid crystal, driver IC. Hence, there arises a problem that the voltage alone can not adjust the driving voltage conditions to optimal ones to obtain satisfactory contrast in a broad range of temperatures.

A technique for effecting temperature compensation by controlling pulse duty while maintaining the maximum contrast voltage is disclosed in, for example, Japanese Laid-Open Patent Application No. 116792/1984 (Tokukaisho No. 59-116792).

According to the above technique, when a voltage corresponding to an ON signal for a selection period is applied, the voltage is not applied in a straight forward manner. Instead, a period for applying the voltage corresponding to the ON signal and a period for applying a voltage corresponding to an OFF signal are provided in a mixed manner to control the pulse duty. The pulse duty throughout the selection periods, during which the voltage corresponding to the ON signal is applied, is controlled in the following manner. That is, a temperature compensating circuit generates a pulse width signal that varies with environmental temperatures, based on which the period for applying the voltage corresponding to the ON signal to each picture element is extended when the temperature is low and shortened when the temperature is high.

The above arrangement of the disclosed technique makes it possible to compensate the temperature dependency of the characteristics of the liquid crystal display element without adjusting the maximum contrast voltage of the liquid crystal display.

In a conventional driving device for driving the liquid crystal display element without changing the pulse duty, the maximum contrast value to achieve an optimal display quality is attained by merely adjusting the liquid crystal driving voltage. To obtain a satisfactory contrast value in a broader range of temperatures, the driving device only has to be modified in such a manner that a higher liquid. crystal driving voltage can be applied. However, there occurs a problem that, if the liquid crystal driving voltage is raised too high, the liquid crystal driving voltage value exceeds a specification value of a withstand voltage for a liquid crystal driving driver IC. This problem could be solved by composing the liquid crystal driving driver IC with component parts which can withstand high voltages. However, in this case, there occurs another problem that a technical breakthrough must be made for producing such a liquid crystal driving driver IC which can withstand high voltages. Moreover, since the component parts are not readily available; even if the liquid crystal driving driver IC which can withstand high voltages is successfully produced, the cost thereof is too high.

The driving method, disclosed in aforementioned Japanese Laid-Open Patent Application No. 116792/1984 (Tokukaisho No. 59-116792), for effecting the temperature compensation by changing the pulse duty can only realize the adjustment by the liquid crystal driving voltage in substantially the same range of temperatures as the range attained by the conventional driving device for driving the liquid crystal display element without changing the pulse duty. The reason is as follows.

That is, to leave a margin for effecting a pulse width control, a pulse width at normal temperature for applying the voltage corresponding to the ON signal must be set shorter than the selection period. Thus, compared with a case where the pulse width control is not effected, the picture elements must be charged in a shorter time, and for this reason, a higher liquid crystal driving voltage needs to be applied. Accordingly, when the method for effecting the pulse width control is adopted, there arises a problem that the liquid crystal driving driver IC must withstand higher voltages compared with its counterpart employed in the conventional driving. device for driving the liquid crystal display element without changing the pulse duty.

SUMMARY OF THE INVENTION

It is therefore an object of the present invention to provide a driving device for driving a liquid crystal display element which can effect a pulse width control that offers an advantage of maintaining a small liquid crystal driving voltage, while compensating the characteristics of the liquid crystal display element in a broader range of temperatures by adjusting the magnitude of the liquid crystal driving voltage.

To fulfill the above and other objects, a driving device for a liquid crystal display element of the present invention, which divides a selection period for setting a display state of a picture element having a 2-terminal element into a plurality of segments and applies different voltages to the picture element in each of the plurality of segments, is characterized by being furnished with:

a dividing section for receiving a logical signal which varies with use environment of the liquid crystal display element, then selecting one dividing ratio pattern from at least two different predetermined dividing ratio patterns in accordance with the logical signal, and dividing the selection period into the plurality of segments based on a selection result, wherein, the picture element is charged by being applied with a predetermined voltage during at least one segment out of the plurality of segments made by the dividing section whether the picture element stays ON or OFF, and charges supplied to the picture element are discharged during at least another segment out of the plurality of segments other than the above one segment in accordance with an ON/OFF state of the picture element.

According to the above arrangement, one dividing ratio is selected from the plurality of predetermined dividing ratio patterns for the selection period in accordance with the logical signal which varies with environment conditions (environmental temperature, for example). Here, the logical signal is defined as a signal obtained by analog-to-digital conversion of an output from a temperature sensor or the like. The dividing ratio patterns are set in such a manner to extend an initial charging period and shorten a following discharging period when the picture element using the 2-terminal element of the liquid crystal display has hard-to-charge and easy-to-discharge characteristics, and to shorten the initial charging period and extend the following discharging period when the picture element has easy-to-charge and hard-to-discharge characteristics.

If the 2-terminal element per se serving as an electronic component at normal temperature has the above-mentioned characteristics, it can be used as an adjusting section. In this case, in response to the characteristics of the 2-terminal element with respect to the environmental temperature, that is, if it is hard to charge and easy to discharge when the temperature is high and easy to charge and hard to discharge when the temperature is low, a predetermined initial voltage is applied to the picture element in such a manner to extend a period for charging the picture element, and a period for discharging the picture element is shortened, whereas when the temperature is high, the predetermined initial voltage is applied to the picture element in such a manner to shorten the period for charging the picture element, and the period for discharging the picture element is extended.

According to the above driving, the voltage-vs.-contrast characteristics in each temperature range can be approximated to those at normal temperature by applying a suitable dividing ratio pattern for the selection period in each temperature range. In other words, satisfactory display contrast can be obtained in a broad range of temperatures by switching the dividing ratio pattern for the selection period in each temperature range.

Also, in the above driving, unlike the case of effecting the pulse width control disclosed in aforementioned Japanese Laid-Open Patent Application No. 116792/1984 (Tokukaisho No. 59-116792), a voltage value of the driving voltage applied to each picture element during the selection period can be set to a value as small as the one in the case where the pulse width control is not effected. Thus, since the driving device for the liquid crystal display element of the present invention has a margin for a higher driving voltage, the driving voltage can be adjusted at the same time.

It is preferable to arrange the driving device for the liquid crystal display element of the present in such a manner that the dividing section includes a timing signal generating section for generating a timing signal which divides selection periods following the above selection period into the plurality of segments in accordance with a signal indicating the above selection period and a reference clock signal in sync with the above selection period and having a cycle shorter than the above selection period, wherein the timing signal generating section is composed of:

a counter for counting a reference clock in accordance with the signal indicating the above selection period; and a plurality of gates for receiving a pre-set clock value for the dividing ratio selected and a count value of the counter, and for generating the timing signal when the count value reaches the pre-set clock value, at least one of the plurality of gates being selected in accordance with the logical signal when the timing signal is generated.

According to the above arrangement, in case that the number of the reference clock for one selection period is limited to a specific value, the counter counts the number of the reference clock for one selection period in accordance with the signal indicating the above selection period (for example, a horizontal direction synchronizing signal), and outputs the count value to the gates. The gates also receive a predetermined clock value for the selected dividing ratio so as to generate the timing signals when the input count value reaches the predetermined clock value. The gates further receive the logical signal and at least one of the gates is selected by the same.

Accordingly, the driving device for the liquid crystal display element of the present invention can supply a stable timing signal in a circuit of a minimum size (least number of the gates) by means of a logical circuit alone. For example, the driving device for the liquid crystal display element of the present invention is applicable to a case where the specification for an external interface signal from an external circuit is limited to one kind, such as a television standard represented by NTSC and in the field of portable information terminals. In other words, the driving device for the liquid crystal display element of the present invention is, applicable in the field of OA systems where the liquid crystal display is designed as an integral component part of a system unit, thereby making it possible to downsize the liquid crystal display while saving the costs.

It is preferable to arrange the driving device for the liquid crystal display element of the present invention in such a manner that the dividing section includes:

a parameter computing section for computing a parameter used for dividing selection periods following the above selection period in accordance with a signal indicating the above selection period and a reference clock signal in sync with the above selection period and having a cycle shorter than the above selection period;

a storage section for storing the parameter; and a timing generating section for generating a timing signal out of the signal indicating the above selection period and a reference clock signal, the timing signal dividing selection periods following the above selection period into the plurality of segments in accordance with the parameter, the parameter computing section including a plurality of sections respectively corresponding to the dividing ratio patterns, one of the plurality of the sections being selected in accordance with the logical signal when the timing signal is generated.

According to the above arrangement, the parameter computing section computes the parameter for the liquid crystal display element in accordance with the reference clock signal before the timing generating section generates the timing signal. The timing generating section generates the timing signal based on the above parameter.

Accordingly, the driving device for the liquid crystal display element of the present invention can divide each selection period with a desired dividing ratio regardless of the number of the reference clocks for one selection period. Further, the driving device for the liquid crystal display element of the present invention can operate on the specification for an external interface signal having a different number of the reference clocks for one selection period and sending a signal that determines the selection period at different timing. In other words, the driving device for the liquid crystal display element of the present invention can operate with an external circuit which generates an external interface signal to be sent to the liquid crystal display in accordance with a different specification.

In the field of general OA systems, such as personal computers, where most of the external circuits generally are display control circuits developed by a third party, the specifications of the external interface signals outputted from each display control circuit are slightly different one from another. However, the driving device for the liquid crystal display element of the present invention can operate with the display control circuit of any kind, and therefore can be shared among the users. In short, the driving device for the liquid crystal display element of the present invention has versatility and is expected to offer advantages of mass production.

In addition, the driving device for the liquid crystal element of the present invention uses only the signals supplied to the liquid crystal display from the external circuit without fail as the external interface signal, whereas the signal that determines the dividing timing of the selection period is generated inside the driving device for the liquid crystal element of the present invention. Thus, it is not necessary to separately provide the signal for dividing the selection period to the driving device form the liquid crystal display element of the present invention from the external circuit.

Consequently, the driving device for the liquid crystal display element of the present invention can maintain the interface. with the external circuit in the same manner as the conventional liquid crystal display which does not divide the selection period. Thus, the driving device for the liquid crystal display element of the present invention can use an external display control circuit designed for the conventional driving device for the liquid crystal display element which does not divide the selection period.

Moreover, the driving device for the liquid crystal display element of the present invention can omit additional circuit components for generating the signal which determines the dividing timing of the selection period, such as quartz oscillator and a PLL (Phase Locked Loop) circuit, thereby realizing a simple, downsized, less expensive, and less power-consuming driving device for the liquid crystal display element.

It is preferable to arrange the driving device for the liquid crystal display element of the present invention in such a manner that the logical signal is inputted through an external switch provided to a main body of a system employing the liquid crystal display element, the external switch enabling a user to select the dividing ratio for the selection period directly.

According to the above arrangement, the logical signal is inputted through the external switch provided to the system main body, so that the user can select any dividing ratio for the selection period by himself. Also, since the user adjusts the dividing ratio with the driving device for the liquid crystal display element of the present invention, an expensive and large-space occupying component, such as a temperature compensating circuit, can be omitted, thereby making it possible to provide an inexpensive and simple temperature compensating section.

It is preferable to arrange the driving device for the liquid crystal display element of the present invention in such a manner that the logical signal is inputted through a logical circuit which selects a dividing ratio suitable for environmental conditions predicted from regional information, calendar information and use environmental information, under which a main body of a system employing the liquid crystal display element is used.

According to the above arrangement, the system main body can learn whether the temperature conditions in the environment in which the system main body is used are those in the summer time in a range between normal temperature (about 20° C.) and high temperature (40° C. or higher), or those in the winter time in a range between normal temperature and low temperature (about 0° C.). Thus, the driving device for the liquid crystal display element of the present invention can set the operation environmental conditions by selecting a pulse width dividing ratio suitable to the environmental conditions predicted from the aforementioned information as the pulse width dividing ratio to be applied to each picture element, thereby making it possible to compensate the operation of the liquid crystal display element. In addition, since the system main body adjusts the dividing ratio based on the pre-stored information, an expensive and large-space occupying component, such as a temperature compensating circuit, can be omitted. Consequently, a simple and inexpensive temperature compensating section can be provided.

It is preferable to arrange the driving device for the liquid crystal display element of the present invention in such a manner that the logical signal changes the dividing, ratio for the selection period during the operation.

According to the above arrangement, the driving device for the liquid crystal display element of the present invention can change the dividing ratio while the power source stays ON, without initializing the liquid crystal display by turning OFF the power source. Thus, the pulse width dividing ratios can be compared with each other more readily, and the driving conditions can be adjusted to the optimal ones more easily.

The driving device for the liquid crystal display element of the present invention can be arranged in such a manner that the timing generating section changes the dividing ratio for the selection period per frame during the operation.

According to the above arrangement, the driving device for the liquid crystal display element of the present invention can change the dividing ratio for the selection period immediately after the number of the reference clocks for the selection period is changed.

Consequently, the driving device for the liquid crystal display element of the present invention can constantly drive the liquid crystal display element under optimal driving conditions.

The driving device for the liquid crystal display element of the present invention can be arranged in such a manner that the timing generating section changes the dividing ratio for the selection period once in every certain number of frames.

According to the above arrangement, the driving device for the liquid crystal display element of the present invention saves the power consumption of the entire system while driving the display liquid crystal element under the optimal driving conditions by changing the dividing ratio for the selection period once in every certain number of frames.

For a fuller understanding of the nature and advantages of the invention, reference should be made to the ensuing detailed description taken in conjunction with the accompanying drawings.

BRIEF DESCRIPTION OF THE DRAWINGS

FIG. 5(*a*) is a timing chart showing an operation of the timing generating circuit of FIG. 4;

FIG. 5(*b*) is a timing chart showing an operation of another timing generating circuit of FIG. 6;

FIG. 9(*b*) shows a waveform of an A/C signal in the conventional liquid crystal display;

FIG. 9(*c*) shows a waveform of a voltage applied to a currently selected scanning electrode line in the conventional liquid crystal display;

FIG. 9(*d*) shows a waveform of a voltage applied to a currently selected data electrode line in the conventional liquid crystal display;

FIG. 9(*e*) shows a waveform of a voltage applied to a picture element connected to the currently selected scanning electrode line and data electrode line.

DESCRIPTION OF THE EMBODIMENTS

Referring to FIGS. 1 through 6, the following description will describe an example embodiment of the present invention.

Figure 1:
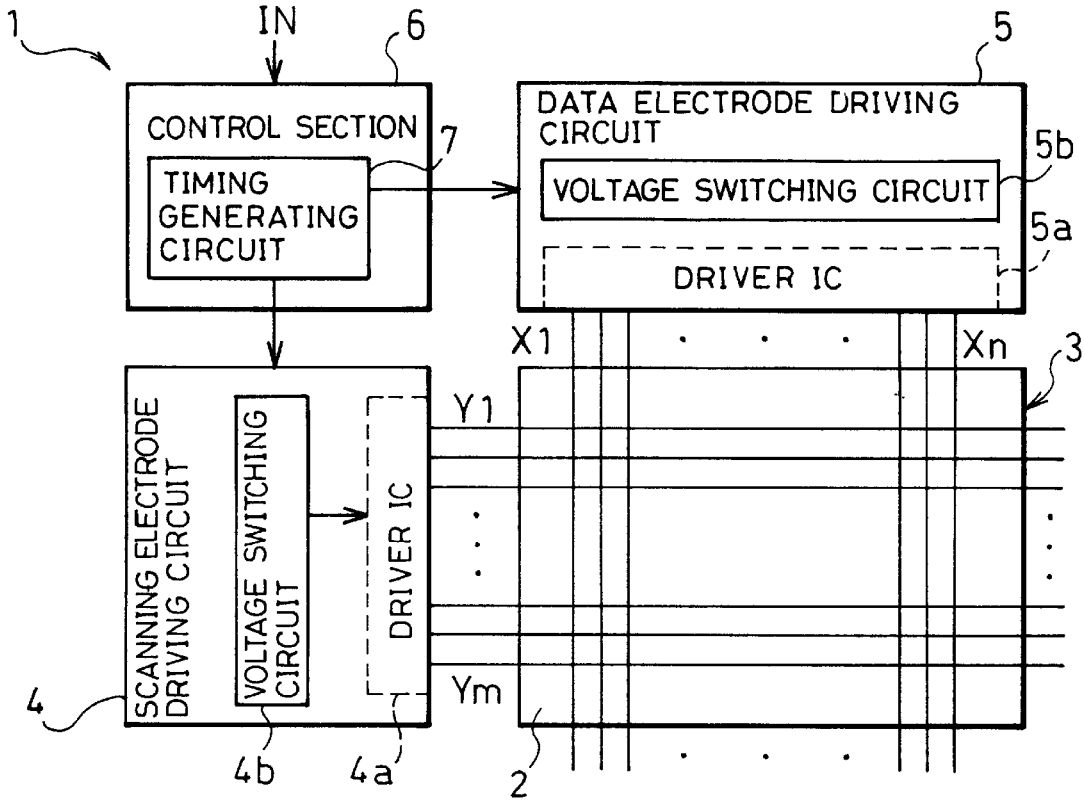
FIG. 1 is a block diagram depicting a major portion of a liquid crystal display in accordance with an example embodiment of the present invention.
Figure 2:
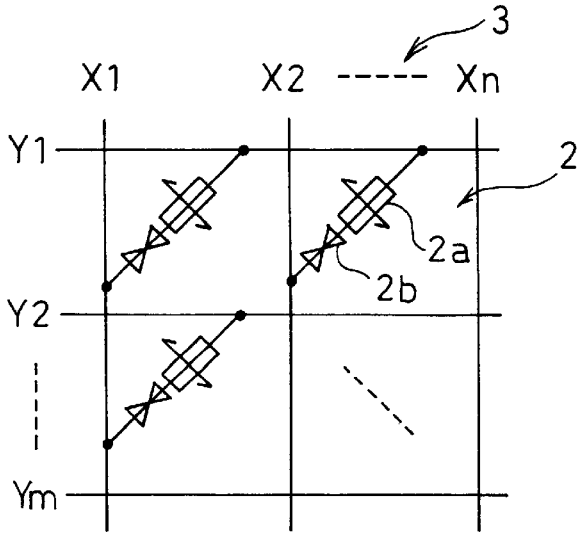
FIG. 2 is a circuitry diagram depicting a major arrangement of picture elements in the liquid crystal display.

As shown in FIG. 1, a liquid crystal display 1 of the present embodiment includes a display panel (liquid crystal display element) 3 composed of data electrode lines X1–Xn, scanning electrode lines Y1–Ym that intersect with the data electrode lines X1–Xn, and picture elements 2 provided individually in portions enclosed by the data electrode lines X1–Xn and scanning electrode lines Y1–Ym. As shown in FIG. 2, each picture element 2 includes a 2-terminal type non-linear element 2*a*, such as an MIM element, and a liquid crystal element 2*b*, which are connected to each other in series. An electrode of the 2-terminal type non-linear element 2*a* which is not connected to the liquid crystal element 2*b* is connected to a corresponding scanning electrode Yj. An electrode of the liquid crystal element 2*b* which is not connected to the 2-terminal type non-linear element 2*a* is connected to a corresponding data electrode Xi.

Also, the liquid crystal display 1 includes a scanning electrode driving circuit 4 for driving the scanning electrode lines Y1–Ym on the display panel 3 line-sequentially, a data electrode driving circuit 5 for applying a driving voltage to the data electrode lines X1–Xn also on the display panel 3 line-sequentially, and a control section (dividing means) 6 for controlling the scanning electrode driving circuit 4 and data electrode driving circuit 5 in accordance with an external interface signal IN supplied from an unillustrated external circuit. Note that the scanning electrode driving circuit 4, data electrode driving circuit 5, and control section 6 form the driving device for the liquid crystal display element in the present embodiment.

The scanning electrode driving circuit 4 is composed of, for example, a controller section, a shift register, an analog switch, etc., and includes a driver IC (Integrated Circuit) 4*a* for driving the scanning electrode lines Y1–Ym individually, and a voltage switching circuit 4*b* for supplying a driving voltage to the driver IC 4*a*. The voltage switching circuit 4*b* selects one of the voltages at different levels applied by an unillustrated power source circuit at a command from the control section 6, and supplies the same to the driver IC 4*a*. This allows the scanning electrode circuit 4 to apply a driving voltage corresponding to the command from the control section 6 to a currently selected scanning electrode line Yj during the selection period. On the other hand, the data electrode driving circuit 5 includes a driver IC 5*a* for driving the data electrode lines X1–Xn individually, and a voltage switching circuit 5*b* for supplying a driving voltage to the driver IC 5*a*. The driver IC 5*a* is composed of, for example, a controller section, a shift register, a latch section, an analog switch, etc., and is able to hold the data signal DATA for one scanning electrode line Yj. The driver IC 5*a* is also able to apply a driving voltage to each of the data electrode lines X1–Xn in accordance with the held data signal DATA during the selection period for the scanning electrode line Yj.

The control section 6 includes a timing generating circuit 7 (timing signal generating means) for generating signals indicating divided segments T1, . . . by dividing each selection period with a selected pulse width dividing ratio in accordance with the external interface signal IN. The external interface signal IN includes a signal for selecting a pulse width dividing ratio in addition to the conventional timing signals for driving the liquid crystal display shown in FIG. 4. An arrangement and an operation of the timing generating circuit 7 will be described below.

While the scanning electrode line Yj is selected, a voltage, as large as a difference between a driving voltage for the data electrode lines X1–Xn and a driving voltage for the scanning electrode Yj, is applied to all the picture elements 2 connected to the scanning electrode line Yj.

Next, a driving method of the liquid crystal display element of the present embodiment will be explained in the following.

In the present driving method of the liquid crystal display element, a 1-line selection period (selection period) is divided to a writing period for charging the picture elements 2 with a predetermined amount of charge whether the picture elements 2 are ON or OFF, and an erasing period for discharging the charge supplied to the picture elements 2 during the writing period in response to a data signal supplied from the data electrode lines X–Xn. The writing period is switched to the erasing period and vice versa by a timing signal outputted from the timing generating circuit 7. It should be appreciated that the, 1-line selection period can be divided into more than two segments by providing the above writing and erasing periods repetitively or by additionally providing a rest period where no voltage is applied, for example.

The 1-line selection period is of a constant length regardless of a change in environmental temperatures or the like as long as the external interface signal IN remains intact. In contrast, a dividing ratio of the writing period and erasing period can be changed in response to the environmental temperatures. For example, when the temperature is high, the writing period is extended while the erasing period is shortened, and conversely, when the temperature is low, the writing period is shortened while the erasing period is extended. When the driving method adopting a suitable dividing ratio pattern for each temperature range is carried out in the above manner, the voltage-vs.-contrast characteristics in each temperature range (high and low temperature ranges) can be approximated to those at normal temperature. In other words, the driving device for the liquid crystal display element of the present embodiment attains satisfactory display contrast in a broader range of temperatures by switching a dividing ratio pattern for each temperature range.

Also, different from the conventional driving method for effecting the pulse width control disclosed in aforementioned Japanese Laid-Open Patent Application No. 116792/

1984 (Tokukaisho No. 59-116792), the driving device for the liquid crystal display element of the present embodiment can set the driving voltage, which is applied to each picture element 2 during the writing period, to a value substantially as small as the one used in the driving method without effecting the pulse width control.

Thus, since a margin for a higher driving voltage is secured, the driving device for the liquid crystal display element of the present embodiment can adjust the driving voltage at the same time. To be more specific, the driving device for the liquid crystal display element of the present embodiment not only changes the dividing ratio of the writing period and erasing period by effecting the pulse width control, but also effects a control to drop the driving voltage when the temperature is high and raise the driving voltage when the temperature is low. In this manner, by effecting the pulse width control and adjusting the driving voltage at the same time, the driving device for the liquid crystal display element of the present embodiment can attain temperature compensation in a broader range of temperatures and higher contrast compared with a case of effecting the temperature compensation by the driving method for effecting the pulse width control alone.

As previously mentioned, the writing period is switched to the erasing period and vice versa by the timing signal outputted from the timing generating circuit 7 in the above-described pulse width control. In the following, an operation of the timing generating circuit 7 will be explained for further understanding.

The timing generating circuit 7 selects one dividing pattern from a plurality of predetermined dividing patterns in accordance with a pulse width dividing ratio selection signal (logical signal, which is referred to as SEP signal hereinafter) in response to the environmental temperatures, and generates a timing signal corresponding to the selected dividing pattern.

In the present embodiment, only one SEP signal is used for the explanation's convenience. The SEP signal is an analog-to-digital converted output from a temperature sensor or the like, and indicates the current state by exhibiting an "L" or an "H". More specifically, the SEP signal varies with ambient temperature and exhibits "H" when the ambient temperature is above a predetermined reference temperature and "L" when the former is below the latter.

In the following explanation, assume that the pulse width dividing ratio selected by the SEP signal divides the 1-line selection period into three timing segments, which are referred to as a first divided segment, a second divided segment, and a third divided segment from the top. Here, if the first divided segment is the writing period, the other divided segments, namely the second and third divided segments, are both the erasing periods or a combination of the erasing period and rest period.

In case of dividing the 1-line selection period into three segments, the timing generating circuit 7 must generate a signal showing a boundary between the first and second divided segments, and another signal showing a boundary between the second and third divided segments. Here, let the former signal be LP1, and the latter signal be LP2.

Figure 3:
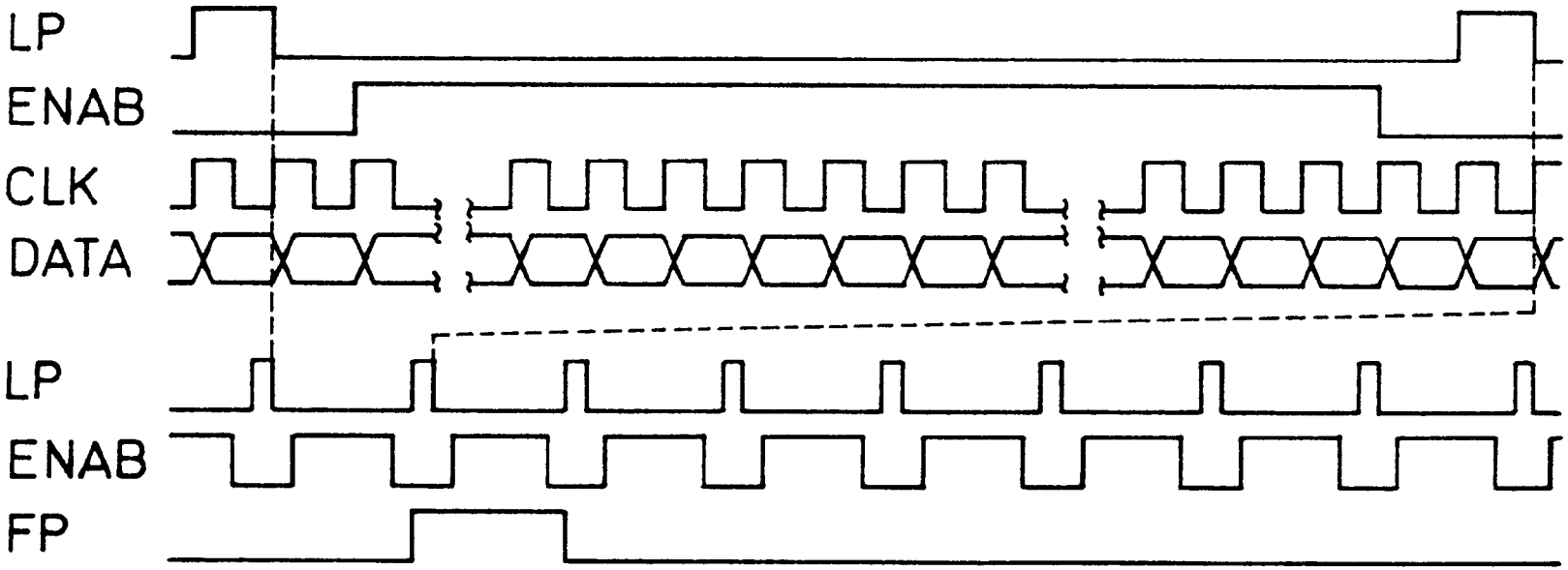
FIG. 3 shows waveforms of example signals supplied externally to the liquid crystal display.

When the SEP signal exhibits "L", a dividing ratio of the first through third divided segments is set to 1:1:1, and when the SEP signal exhibits "H", a dividing ratio is set to 2:1:1. Further, the number of reference clocks for one horizontal period is limited to 800, and signals shown in FIG. 3 are used as input signal waveforms.

Figure 4:
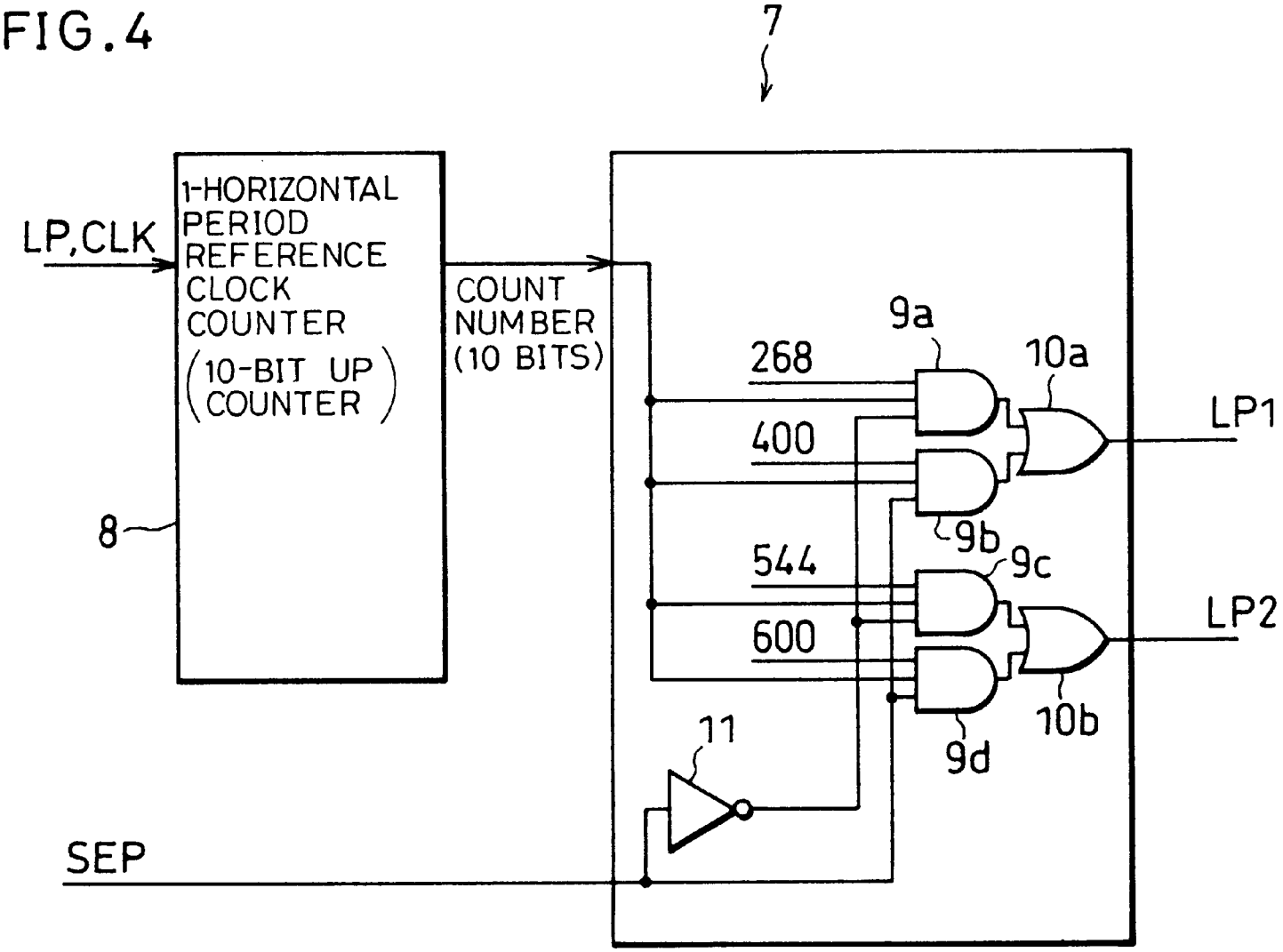
FIG. 4 is a block diagram depicting an example arrangement of a major portion of a timing generating circuit in the liquid crystal display.

Next, a more specific circuitry arrangement of the timing generating circuit 7 in the control section 6 will be explained in the following. As shown in FIG. 4, the timing generating circuit 7 is composed of a 1-horizontal period reference clock counter 8, four AND gates 9*a* through 9*d*, two OR gates 10*a* and 10*b*, and an inverter 11. The 1-horizontal period reference clock counter 8 counts up from 0 to 799 in accordance with the number of the reference clock pulses for one horizontal period. The 1-horizontal period reference clock counter 8 counts up at the falling of the reference clock CLK, and it counts 0 (zero) at the falling of the reference clock CLK when the horizontal direction synchronizing signal LP exhibits "H". Here, a 10-bit up counter is used as the 1-horizontal period reference clock counter 8, because the 10-bit up counter has a capability of counting from 0 to 1023, and therefore, it is sufficiently large to count the reference clock pulses CLK limited to 800.

In the above-arranged timing generating circuit 7, the 1-horizontal period reference clock counter 8 counts up from 0 to 799 in accordance with the input reference clock CLK and horizontal direction synchronizing signal LP. The count number thus obtained is inputted to each of the AND gates 9*a* through 9*d*. Here, the AND gates 9*a* and 9*c* receive the SEP signal through the inverter 11, while the AND gates 9*b* and 9*d* receive the SEP signal directly. Thus, when the SEP signal exhibits "H", the AND gates 9*a* and 9*c* receive a signal in the "L" level, while the AND gates 9*b* and 9*d* receive a signal in the "HI" level, whereby the AND gates 9*b* and 9*d* are selected. Conversely, when the SEP signal exhibits "L", the AND gates 9*a* and 9*c* are selected.

Each AND gate selected by the SEP signal outputs a signal that shifts to the "H" level at predetermined timing in accordance with a count signal inputted from the 1-horizontal period reference clock counter 8. The other non-selected AND gates keep outputting a signal in the "L" level. The, operation of the timing generating circuit 7 under these conditions will be detailed in the following. For example, when the SEP signal exhibits "H", the AND gates 9*b* and 9*d* are selected as mentioned above. The AND gate 9*b* is supplied with a predetermined value 400 constantly, and when the count signal inputted from the 1-horizontal period reference clock counter 8 reaches 400, the output from the AND gate 9*b* shifts to the "H" level. The, output from the AND gate 9*b* is supplied to the OR gate 10*a* like the output from the AND gate 9*a*. Since the output from the AND gate 9*a* stays in the "L" level constantly, the timing signal LP1 outputted from the OR gate 10*a* varies in the same manner as the output from the AND gate 9*b*. Thus, in this case, the timing signal LP1 is a pulse signal that shifts to the "H" level at the timing at which the count number reaches 400. Also, since the AND gate 9*d* is supplied with a predetermined value 600 constantly, the timing signal LP2 is a pulse signal that shifts to the "H" level at the timing at which the count number reaches 600.

On the other hand, when the SEP signal exhibits "L", the AND gates 9*a* and 9*c* are selected, and the AND gate 9*a* is constantly supplied, with a predetermined value 268 while the AND gate, 9*c* is constantly supplied with a predetermined value 544. Thus, the timing signal LP1 is a pulse signal that shifts to the "H" level at the timing at which the count number reaches 268, while the timing signal LP2 is a pulse signal that shifts to the "H" level at the timing at which the count number reaches 544 (See FIG. 5(*a*)). As has been explained, the driving device for the liquid crystal display element of the present embodiment can generate the timing signal indicating the dividing positions at which each 1-line selection period following a particular 1-line selection period is divided into a plurality of; segments in accordance with the signal LP indicating that particular 1-line selection period and the reference clock signal CLK in response to the state of the SEP signal.

In the above explanation, the number of the reference clocks CLK, inputted for one cycle of the horizontal direction synchronizing signal LP, that is, 1-line selection period, is limited to 800. However, it is often very difficult to limit the count of the reference clock for a 1-line selection period to one specific value due to the specifications of an external circuit that generates the external interface signal IN. For example, when the display control circuit is designed, a different reference clock number is set for the 1-line selection period depending on whether a DRAM that requires a refresh pulse is used as a memory IC for storing the data signal.

If the reference clock count for the 1-line selection period varies as described above, the above-arranged timing generating circuit 7 can hardly generate the timing signal in response to a predetermined dividing ratio. Thus, in this case, the timing generating circuit 7 is replaced with a timing generating circuit 12 which can generate the timing signal in response to a predetermined dividing ratio even when the number of the reference clocks varies.

Figure 6:
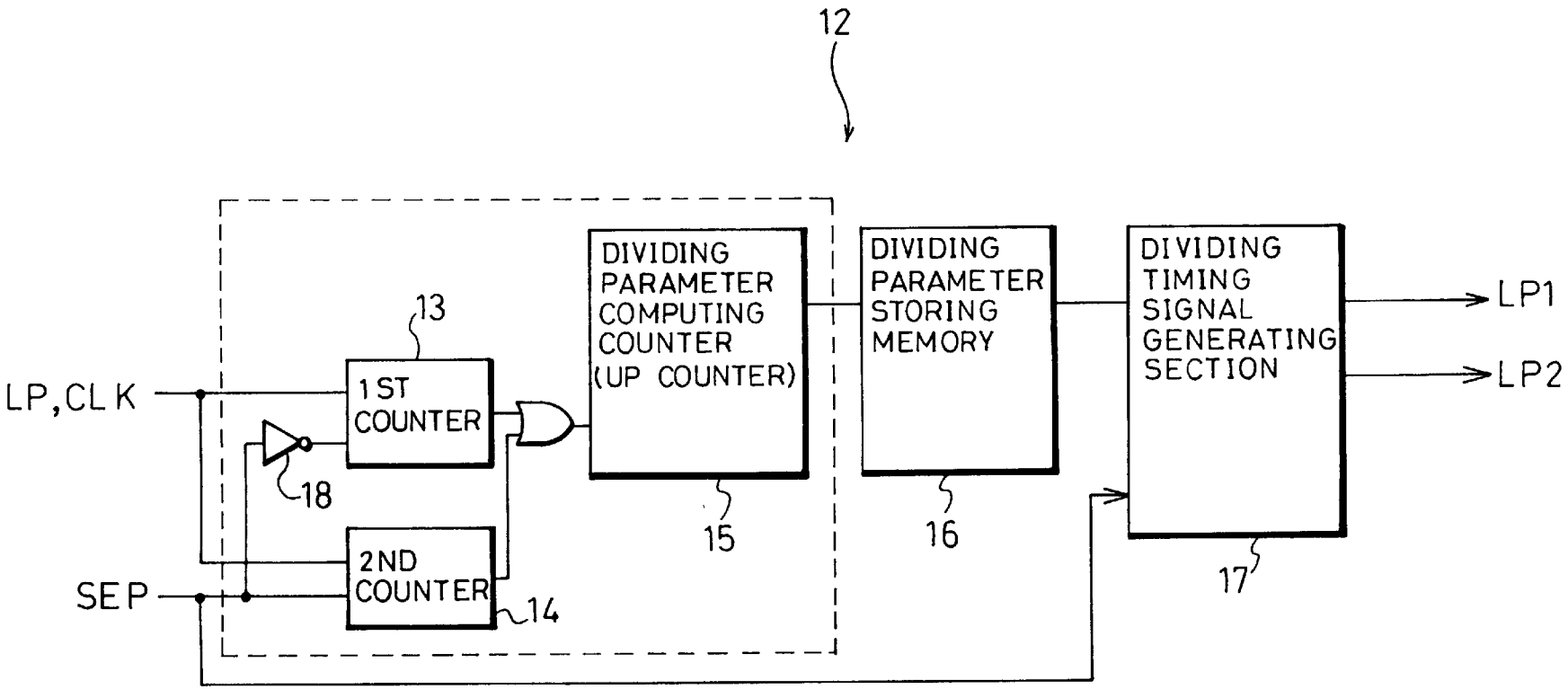
FIG. 6 is a block diagram depicting an example arrangement of a major portion of the timing generating circuit operating at the timing shown in FIG. 5(*b*)
Figure 7:
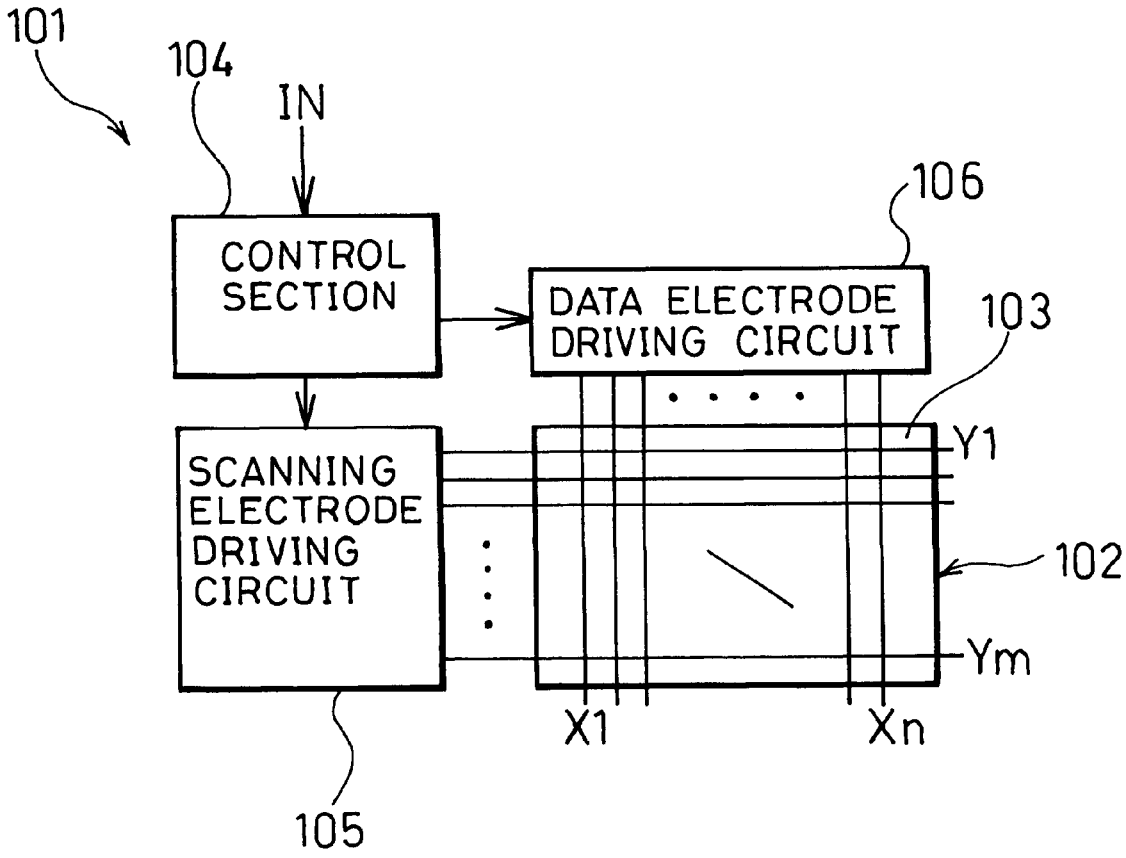
FIG.7 PRIOR ART
FIG. 7 is a block diagram depicting a major portion of a conventional liquid crystal display.
Figure 8:
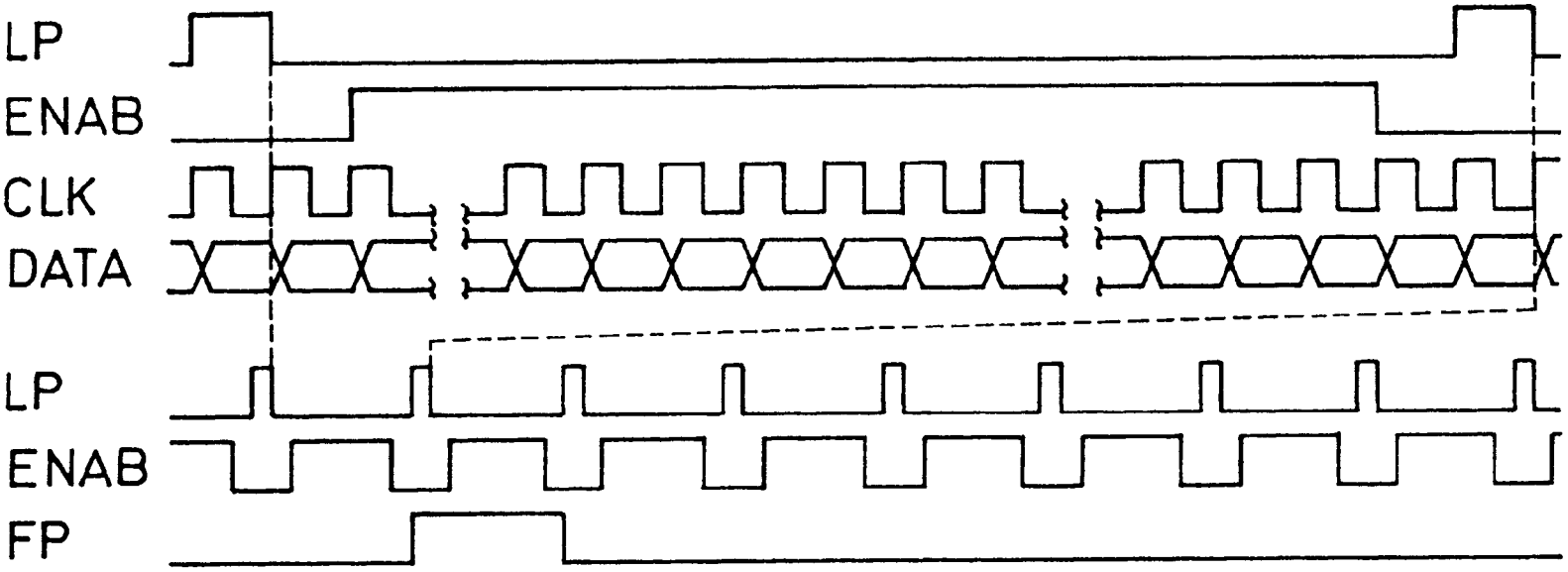
FIG.8 PRIOR ART
FIG. 8 shows waveforms of example signals supplied from an external to the conventional liquid crystal display.
Figures 9A, 9B, 9C, 9D, 9E:
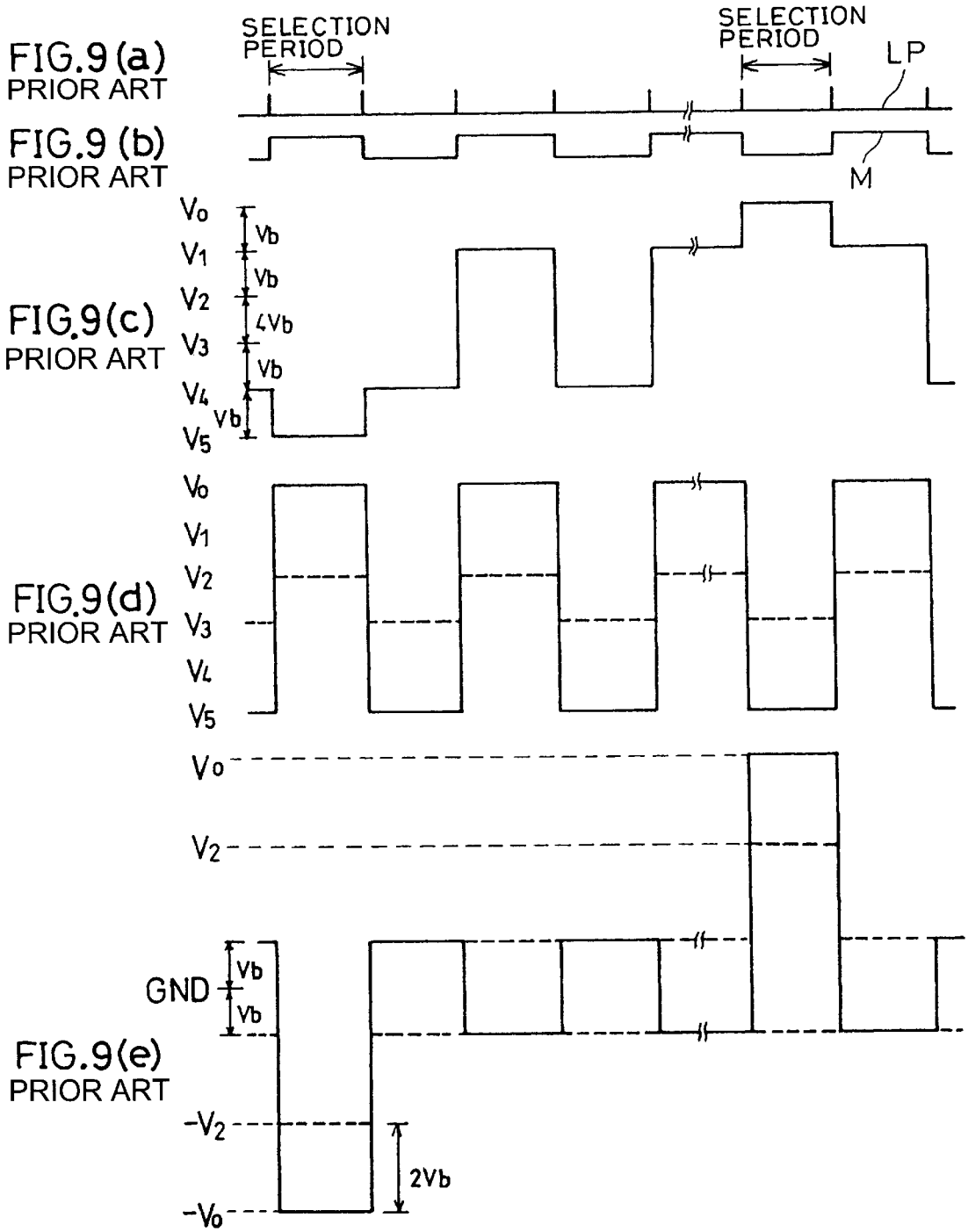
FIG.9(a) PRIOR ART
FIG.9(b) PRIOR ART
FIG.9(c) PRIOR ART
FIG.9(d) PRIOR ART
FIG.9(e) PRIOR ART
FIG. 9(*a*) shows a waveform of a horizontal direction synchronizing signal in the conventional liquid crystal display.
Figure 10:
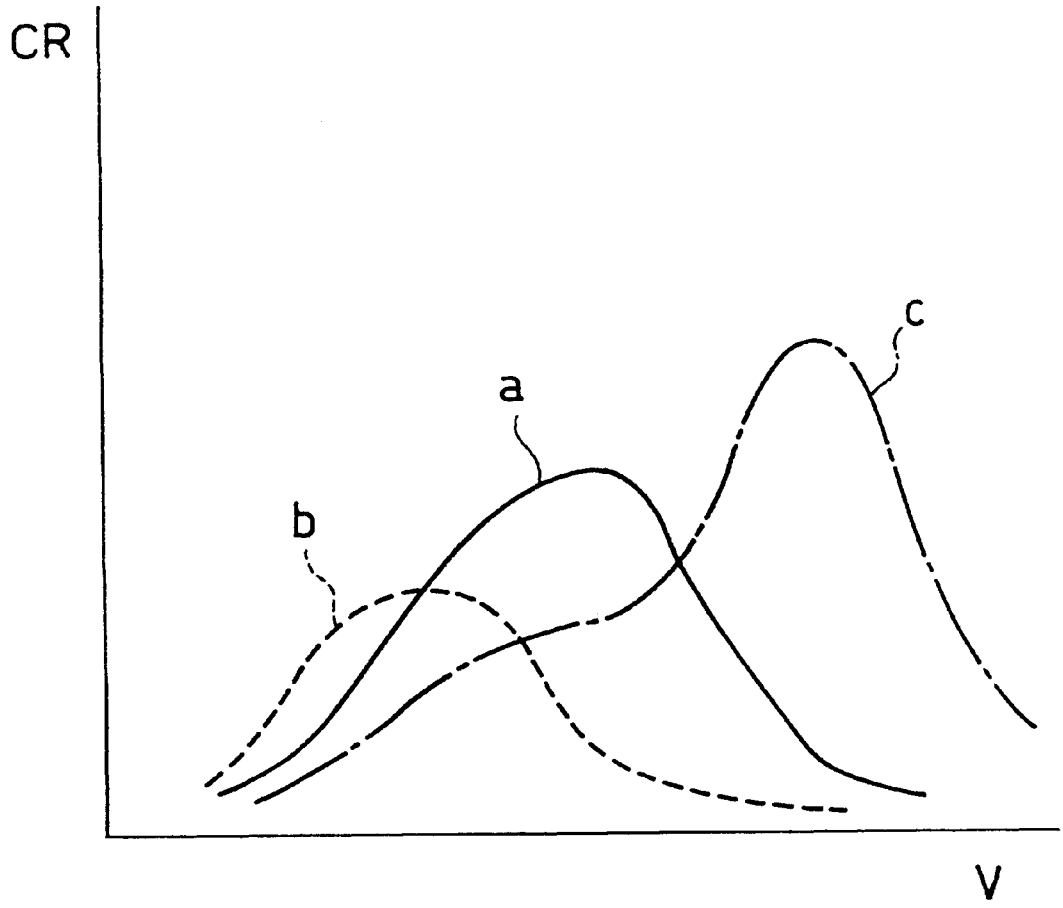
FIG.10 PRIOR ART
FIG. 10 is a graph showing a voltage-vs.-contrast characteristics of a liquid crystal display using 2-terminal elements when driven by a conventional method without effecting temperature compensation.

As shown in FIG. 6, the timing generating circuit 12 is composed of a first counter 13, a second counter 14, a dividing parameter computing counter 15, a dividing parameter storing memory 16 (storage means), and a dividing timing signal generating section 17 (timing generating means). The timing generating circuit 12 divides the 1-line selection period into a plurality of segments equally by a predetermined number found from the pulse width dividing ratio in accordance with the reference clock CLK. The timing generating circuit 12 generates a timing signal indicating each divided segment based on the predetermined number of equally divided segments. Hereinafter the predetermined number by which the 1-line selection period is equally divided is referred to as an equi-dividing constant, and the equally divided segments are referred to as equi-divided segments. The equi-dividing constant is a sum of the pulse width dividing ratio when the pulse width dividing ratio is expressed by integers. For example, in case that the SEP signal exhibits "L", where the pulse width dividing ratio is 1:1:1, the equi-dividing constant is set to 3. In a case that the SEP signal exhibits "H", where the pulse width dividing constant is 2:1:1, the equi-dividing ratio is set to 4. The equi-divided segment means a segment obtained by dividing the 1-line selection period by the equi-dividing constant. Note that the first counter 13, second counter 14, dividing parameter computing counter 15 could, for example, in one aspect of the invention, form parameter computing means referred to in Claims of the present invention set forth below.

Next, the operation of the timing generating circuit 12 will be explained in the following.

The first counter 13 and second counter 14 receive both the horizontal direction synchronizing signal LP and reference clock CLK. Also, the first counter 13 receives the SEP signal through an inverter 18, while the second counter 14 receives the same directly. Consequently, when the SEP signal exhibits "L", the first counter 13 is selected by the SEP signal, and when the SEP signal exhibits "H", the second counter 14 is selected by the SEP signal.

In the first place, a case where the SEP signal exhibits "H" will be explained. In this case, the second counter 14 is selected as mentioned above, and the second counter 14 repetitively counts the input reference clock CLK up to four, which is the equi-dividing constant in this case. The count number of the second counter 14 overflows each time the count number reaches four, whereupon the second counter 14 outputs a pulse signal to the dividing parameter computing counter 15. The dividing parameter computing counter 15 counts up one each time it receives the pulse signal from the second counter 14.

Accordingly, after the reference clock pulses CLK for the 1-line selection period are inputted to the timing generating circuit 12, the dividing parameter computing counter 15 counts a quotient obtained by dividing the numbers of the reference clocks CLK by the equi-dividing constant 4, namely, the clock count that equals to the equi-divided segments. The count value of the dividing parameter computing counter 15 is stored in the dividing parameter storing memory 16.

The dividing timing signal generating section 17 generates the timing signals LP1 and LP2 in accordance with the SEP signal and the value stored in the dividing parameter storing memory 16. In other words, the dividing timing signal generating section 17 recognizes the pulse width dividing ratio with the input SEP signal. Since the SEP signal exhibits "H" in this case, the dividing ratio is 2:1:1. Then, the dividing timing signal generating section 17 reads the value stored in the dividing parameter storing memory 16. For example, if the current clock number, of the reference clock is 800, then the value stored in the dividing parameter storing memory 16 is the quotient when the current count number of the reference clock is divided by the equi-dividing constant, that is, 800÷4=200. The dividing timing signal generating section 17 computes the timing signals LP1 and LP2 by multiplying 200 thus computed by the dividing ratios. That is, LP1=200×2=400, and LP2=200×(2+1)=600 (See FIG. 5(*b*)).

On the other hand, in case that the SEP signal exhibits "L", the first counter 13 is selected. The first counter 13 repetitively counts up the input reference clock CLK until the count number reaches 3, which is the equi-dividing constant in this case. The operation is identical with the case where the SEP signal exhibits "H", and the explanation of which is not repeated for convenience.

The dividing parameter computing counter 15 and dividing parameter storing memory 16 may be activated for each frame, or for every certain number of frames. In the former case, when the count number of the reference clock for the 1-line selection period of the input signal is changed, the pulse width dividing ratio is immediately changed as well, thereby making it possible to drive the liquid crystal display element constantly under optimal driving conditions. In the latter case, the power consumption of the system can be reduced while maintaining the optimal driving conditions for the liquid crystal display element by activating a pulse width dividing ratio updating circuit less frequently.

The driving device for the liquid crystal display element of the present embodiment generates the SEP signal by analog-to-digital conversion of the output from the temperature sensor, but the generating means of the SEP signal is not limited to the above disclosure. For example, an external switch may be provided to the system main body employing the above liquid crystal display element, so that the user can select the dividing ratio for the selection period directly and the SEP signal is generated by the user's manipulation of the external switch. In this case, since the SEP signal is inputted from the external switch provided to the system main body, the user can select a desired dividing ratio for the selection period. In addition, since the user adjusts the dividing ratio for the selection period by himself, an expansive and large-space occupying component, such as a temperature compensating circuit, can be omitted. Accordingly, the driving device for the liquid crystal display of the present embodiment can provide simple and inexpensive temperature compensating means.

Alternatively, the SEP signal may be inputted from a logical circuit capable of selecting a dividing ratio corresponding to the environmental conditions predictable from the regional information, calendar information and use environmental information in which the system main body is used. In this case, the system main body can learn from the regional information, calendar information, and use environmental information whether the temperature conditions in the environment the system main body is used are those in the summer time in a range between normal temperature (about 20° C.) and high temperature (40° C. or higher), or those in the winter time in a range between normal temperature and low temperature (about 0° C.). Thus, the operation environmental conditions can be set by selecting a pulse width dividing ratio suitable to the environmental conditions predicted by the above information so as to be applied to the liquid crystal display element, thereby making it possible to compensate the operation of the liquid crystal display element. In addition, since the system main body adjusts the dividing ratio based on the pre-stored information, an expensive and large-space occupying component, such as a temperature compensating circuit, can be omitted. Consequently, the driving device of the liquid crystal display element of the present embodiment can provide simple and inexpensive temperature compensating means.

Also, the driving device for the liquid crystal display element of the present embodiment can change the pulse width dividing ratio by monitoring the SEP signal while the power source stays ON without initializing the liquid crystal display by turning OFF the power source. Thus, the pulse width dividing ratios can be compared with each other more readily, and the conditions can be adjusted to the optimal ones more easily.

As has been explained, a driving device for a liquid crystal display element of the present invention, which divides a selection period for setting a display state of a picture element having a 2-terminal element into a plurality of segments and applies different voltages to said picture element in each of said plurality of segments, is arranged in such a manner to comprise:

dividing means for receiving a logical signal which varies with use environment of said liquid crystal display element, then selecting one dividing ratio pattern from at least two different predetermined dividing ratio patterns in accordance with said logical signal, and dividing said selection period into said plurality of segments based on a selection result, wherein, said picture element is charged by being applied with a predetermined voltage during at least one segment out of said plurality of segments made by said dividing means whether said picture element stays ON or OFF, and charges charged to said picture element are discharged during at least another segment out of said plurality of segments other than said one segment in accordance with an ON/OFF state of said picture element.

Accordingly, the voltage-vs.-contrast characteristics of the liquid crystal display element in each temperature range approximate to those at normal temperature by applying a suitable dividing ratio pattern for the selection period in each temperature range by means of the driving, device for the liquid crystal display element. In other words, there can be attained an effect that satisfactory display contrast can be obtained in a broad, range of temperatures by switching the dividing ratio pattern for the selection period in each temperature range.

Also, in the above driving device for the liquid crystal display, a voltage value of the driving voltage applied to each picture element during the selection period can be set toga value as small as the one in the case where the pulse width control is not effected. Thus, since the above driving device for the liquid crystal display element has a margin for a higher driving voltage, the driving voltage can be adjusted at the same time.

The dividing means is arranged in such a manner to include timing signal generating means for generating a timing signal dividing selection periods following said selection period into said plurality of segments in accordance with a signal indicating said selection period and a reference clock signal in sync with said selection period and having a cycle shorter than said selection period, wherein said timing signal generating means is also arranged in such a manner to be composed of:

a counter for counting a reference clock in accordance with said signal indicating said selection period; and a plurality of gates for receiving a pre-set clock value for the dividing ratio selected and a count value of said counter, and for generating said timing signal when said count value reaches said pre-set clock value, at least one of said plurality of gates being selected in accordance with said logical signal when said timing signal is generated.

Accordingly, in case that the count number of the reference clock for one selection period is limited to a specific value, the above driving device for the liquid crystal display element can supply a stable timing signal in a circuit of a minimum size (least number of the gates) by a logical circuit alone. For example, the above driving device for the liquid crystal display element is applicable to a case where the specification for an external interface signal from an external signal is limited to one kind, such as a television standard represented by NTSC and in the field of the information terminals, in other words, in the field of the OA systems where the liquid crystal display is designed as an integral component of a system unit. Hence, there can be offered an effect that a downsized and less expensive liquid crystal display can be provided.

The dividing means is arranged in such a manner to include:

parameter computing means for computing a parameter used for dividing selection periods following said selection period in accordance with a signal indicating said selection period and a reference clock signal in sync with said selection period and having a cycle shorter than said selection period;

storage means for storing said parameter; and timing generating means for generating a timing signal out of said signal indicating said selection period and a reference clock signal, said timing signal dividing selection periods following said selection period into said plurality of segments in accordance with said parameter, said parameter computing means including a plurality of means respectively corresponding to the dividing ratio patterns, one of said plurality of means being selected in accordance with said logical signal when said timing signal is generated.

Accordingly, the above driving device for the liquid crystal display element can divide each selection period with a desired dividing ratio regardless of the count number of the reference clocks for one selection period. Further, the above driving device for the liquid crystal display element can operate on an external interface signal having a different count number of the reference clocks for one selection period and sending a signal which determines the selection period at different timing. Therefore, the above driving device for the liquid crystal display element of the present invention can operate on an external interface signal generated by means of a display control circuit in accordance with a different specification.

In the field of the OA systems, such as personal computers, where most of the external circuits are generally display control circuits developed by a third party, the specifications of the external interface signals outputted from each display control circuit are slightly different one from another. However, the above driving device for the liquid crystal display element can operate on the display control circuit of any kind, and therefore, can be shared among the users. In short, the above driving device for the liquid crystal display element has versatility and is expected to offer advantages of mass production.

In addition, the above driving device for the liquid crystal display element can use, as the external interface signal, external signals supplied to the liquid crystal display, such as a signal in sync with a video signal of the liquid crystal display element. Thus, even when the interface between the external circuit, such as a circuit supplying a video signal, and the above driving device for the liquid crystal display element is provided in the conventional manner, it is not necessary to separately generate a signal for dividing the selection period. Consequently, since the above driving device for the liquid crystal display element can maintain the interface with the external circuit in the conventional manner, it can share the external circuit with the driving device for the liquid crystal display element which does not divide the selection period, or the driving device for the liquid crystal display element having a different dividing ratio. Moreover, a circuit for generating a signal for dividing the selection period, such as a PLL (Phase Locked Loop) circuit, can be omitted. Thus, there can be attained an effect that the driving device for the liquid crystal display element can be further simplified.

Further, the above driving device for the liquid crystal display element is arranged in such a manner that the logical signal is inputted through an external switch provided to a main body of a system employing said liquid crystal display element, said external switch enabling a user to select the dividing ratio for the selection period directly.

Accordingly, since the user adjusts the dividing ratio, the above driving device for the liquid crystal display element can omit an expensive and large-space occupying component, such as a temperature compensating circuit, thereby offering an effect that inexpensive and easy temperature compensating means can be provided.

It is preferable to arrange the above driving device for the liquid crystal display element in such a manner that the logical signal is inputted through a logical circuit which selects a dividing ratio suitable for environmental conditions predicted from regional information, calendar information and use environmental information, under which a main body of a system employing said liquid crystal display element is used.

Accordingly, since the system main body adjusts the dividing ratio based on the pre-stored information, the above driving device for the liquid crystal display element can omit an expensive and large-space occupying component, such as a temperature compensating circuit. Consequently, the above driving device for the liquid crystal display element can offer an effect that simple and inexpensive temperature compensating means can be provided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving device for a liquid crystal display element which provides for division of a 1-line selection period for setting a display state of a picture element having a 2-terminal element into a plurality of timing segments and applies different voltages to said picture element in each of said plurality of timing segments, comprising:

dividing device for receiving a logical signal which varies with an environment of said liquid crystal display element, then selecting one dividing ratio pattern from at least two different predetermined dividing ratio patterns in accordance with said logical signal, and dividing said 1-line selection period into said plurality of timing segments based on a selection result, wherein at least one timing segment of said plurality of timing segments is a writing period for charging said picture element by one of a first predetermined voltage and a second predetermined voltage depending on an ON/OFF state of said picture element, and wherein at least one different timing segment of said plurality of timing segments is an erasing period for discharging said picture element in accordance with the ON/OFF state of said picture element, said first and second predetermined voltages each having a voltage level determined by said environment of said liquid crystal display element.

2. The driving device of claim 1, wherein:

said dividing device includes timing signal generating means for generating a timing signal to divide further or additional 1-line selection periods following said 1-line selection period into said plurality of timing elements in accordance with a signal indicating said 1-line selection period and a reference clock signal in sync with said 1-line selection period and having a cycle shorter than said 1-line selection period; and said timing signal generating means includes a counter for counting a reference clock in accordance with said signal indicating said 1-line selection period, and a plurality of gates for receiving a pre-set clock value for the dividing ratio selected and a count value of said counter, and for generating said timing signal when said count value reaches said pre-set clock value, one of said plurality of gates being selected in accordance with said logical signal when said timing signal is generated.

3. The driving device of claim 1, wherein said dividing device includes:

parameter computing means for computing a parameter used for dividing further or additional 1-line selection periods following said 1-line selection period in accordance with a signal indicating said 1-line selection period and a reference clock signal in sync with said 1-line selection period and having a cycle shorter than said 1-line selection period;

storage means for storing said parameter; and timing generating means for generating a timing signal out of said signal indicating said 1-line selection period and a reference clock signal, said timing signal dividing 1-line selection periods following said 1-line selection period into said plurality of timing segments in accordance with said parameter, said parameter computing means including a plurality of means respectively corresponding to the dividing ratio patterns, one of said plurality of means being selected in accordance with said logical signal when said timing signal is generated.

4. The driving device of claim 1, wherein said logical signal is inputted through an external switch provided to a main body of a system employing said liquid crystal display element, said external switch enabling a user to select the dividing ratio for the 1-line selection period directly.

5. The driving device of claim 2, wherein said logical signal is inputted through an external switch provided to a main body of a system employing said liquid crystal display element, said external switch enabling a user to select the dividing ratio for the 1-line selection period directly.

6. The driving device of claim 3, wherein said logical signal is inputted through an external switch provided to a main body of a system employing said liquid crystal display element, said external switch enabling a user to select the dividing ratio for the 1-line selection period directly.

7. The driving device of claim 1, wherein said logical signal is inputted through a logical circuit which selects a dividing ratio suitable for environmental conditions predicted from regional information, calendar information and operating environment information, under which a main body of a system employing said liquid crystal display device is used.

8. The driving device of claim 2, wherein said logical signal is inputted through a logical circuit which selects a dividing ratio suitable for environmental conditions predicted from regional information, calendar information and operating environment information, under which a main body of a system employing said liquid crystal display device is used.

9. The driving device of claim 3, wherein said logical signal is inputted through a logical circuit which selects a dividing ratio suitable for environmental conditions predicted from regional information, calendar information and operating environment information, under which a main body of a system employing said liquid crystal display device is used.

10. The driving device of claim 1, wherein said logical signal changes the dividing ratio for the 1-line selection period during operation.

11. The driving device of claim 2, wherein said logical signal changes the dividing ratio for the 1-line selection period during operation.

12. The driving device of claim 3, wherein said logical signal changes the dividing ratio for the 1-line selection period during operation.

13. The driving device of claim 3, wherein said timing generating means changes the dividing ratio for the 1-line selection period per frame during operation.

14. The driving device of claim 3, wherein said timing generating means changes the dividing ratio for the 1-selection period once in every fixed number of frames.

15. A driving device for a liquid crystal display element comprising:

driving voltage generating means for generating a driving voltage for displaying a picture element; and dividing means for dividing a 1-line selection period for setting a display state of said picture element into a plurality of timing segments in accordance with an environment of said liquid crystal display element, wherein at least one timing segment of said plurality of timing segments is a writing period for charging said picture element by applying one of a first predetermined voltage and a second predetermined voltage depending on an ON/OFF state of said picture element, and wherein at least one different timing segment of said plurality of timing segments is an erasing period for discharging said picture element in accordance with the ON/OFF state, said first and second predetermined voltages each having a voltage level determined by said environment of said liquid crystal display element.

16. The driving device of claim 15, wherein said driving voltage generating means changes the driving voltage in response to the environment.

17. The driving device of claim 15, wherein:

said dividing means includes timing signal generating means for generating a timing signal for dividing said 1-line selection period into said plurality of segments in accordance with a signal indicating said 1-line selection period and a reference clock signal in sync with said 1-line selection period and having a cycle shorter than said 1-line selection period;

said timing signal generating means includes, a counter for counting said reference clock signal;

a circuit for outputting said timing signal when a count value of said counter reaches a value set based on the use environment.

18. The driving device of claim 15, wherein:

said dividing;means includes timing signal generating means for generating a timing signal for dividing said 1-line selection period into said plurality of segments in accordance with a signal indicating said 1-line selection period and a reference clock signal in sync with said 1-line selection period and having a cycle shorter than said 1-line selection period;

said timing signal generating means includes, a counter for counting clock numbers representing the number of said plurality of segments in accordance with said reference clock signal; and a memory for storing a count value of said counter, said timing signal generating means setting the number of said plurality of segments based on the use environment and generating said timing signal based on the number of said plurality of segments and said count value.

* * * * *